US010244322B2

(12) United States Patent
Geva

(10) Patent No.: US 10,244,322 B2
(45) Date of Patent: Mar. 26, 2019

(54) SPACE FRAME REINFORCED TWEETER DOME

(71) Applicant: YG Acoustics LLC, Arvada, CO (US)

(72) Inventor: Yoav Vince Geva, Arvada, CO (US)

(73) Assignee: YG ACOUSTICS LLC, Arvada, CO (US)

( * ) Notice: Subject to any disclaimer, the term of this patent is extended or adjusted under 35 U.S.C. 154(b) by 108 days.

(21) Appl. No.: 15/290,835

(22) Filed: Oct. 11, 2016

(65) Prior Publication Data

US 2018/0103322 A1 Apr. 12, 2018

(51) Int. Cl.

| | |
|---|---|
| ***H04R 7/26*** | (2006.01) |
| *H04R 7/12* | (2006.01) |
| *H04R 7/24* | (2006.01) |
| *H04R 31/00* | (2006.01) |

(52) U.S. Cl.

CPC ..... *H04R 7/26* (2013.01); *H04R 7/127* (2013.01); *H04R 7/24* (2013.01); *H04R 31/003* (2013.01); *H04R 2307/027* (2013.01)

(58) Field of Classification Search

CPC ..... H04R 9/06; H04R 7/127; H04R 2400/11; H04R 2307/021; H04R 2307/023; H04R 2307/025; H04R 2307/029; H04R 7/08; H04R 7/10; H04R 7/06; H04R 7/04; H04R 7/20; H04R 2207/021; H04R 2231/001; G10K 13/00

USPC ..... 381/353, 354, 398; 181/157, 166–170, 181/173

See application file for complete search history.

(56) References Cited

U.S. PATENT DOCUMENTS

| | | | | | |
|---|---|---|---|---|---|
| 1,720,524 | A | * | 7/1929 | Menkens | H04R 7/14 181/164 |
| 4,132,872 | A | * | 1/1979 | Inoue | H04R 7/14 181/165 |
| 4,761,817 | A | * | 8/1988 | Christie | H04R 7/125 181/157 |
| 4,764,968 | A | * | 8/1988 | Kreitmeier | H04R 7/06 181/163 |
| 4,817,165 | A | * | 3/1989 | Amalaha | H04R 7/122 181/170 |
| 4,819,395 | A | * | 4/1989 | Sugita | E04C 5/07 156/181 |

(Continued)

FOREIGN PATENT DOCUMENTS

| | | | | | |
|---|---|---|---|---|---|
| NZ | 286639 | | * | 6/1997 | B65D 43/02 |
| NZ | 286639 | A | * | 6/1997 | B65D 43/02 |

(Continued)

*Primary Examiner* — Oyesola C Ojo
(74) *Attorney, Agent, or Firm* — Perkins Coie LLP

(57) ABSTRACT

A space frame reinforced tweeter dome is disclosed. The tweeter dome includes a space frame and a convex diaphragm attached to the space frame. The space frame can include a crown portion in the form of a triangular frame and three leg portions each extending from a corresponding vertex of the triangular frame. Each leg portion has a distal foot adapted for connection to a voice coil former for movement therewith. The convex diaphragm can be comprised of a soft, e.g., textile, material while the space frame is comprised of rigid material such as metal. The space frame reinforced tweeter dome is free from ringing while being sufficiently rigid to follow the enormous accelerations of a music signal at high frequencies.

20 Claims, 10 Drawing Sheets

(56) References Cited

U.S. PATENT DOCUMENTS

| | | | | |
|---|---|---|---|---|
| 5,181,355 | A * | 1/1993 | Skolnick | E04B 1/3211 403/385 |
| 6,385,324 | B1 * | 5/2002 | Koppen | H04R 9/06 381/336 |
| 8,428,295 | B2 * | 4/2013 | Humphreys | H04R 9/04 381/386 |
| 8,820,006 | B2 * | 9/2014 | Zook | E04B 1/3211 52/655.1 |
| 8,942,407 | B2 * | 1/2015 | Dodd | H04R 7/02 181/157 |
| 2002/0061117 | A1 * | 5/2002 | Takewa | H04R 7/12 381/430 |
| 2005/0271238 | A1 * | 12/2005 | Kobayashi | H04R 1/24 381/398 |
| 2008/0013781 | A1 * | 1/2008 | Sagren | H04R 9/043 381/398 |
| 2008/0124566 | A1 * | 5/2008 | Smallman | C22C 26/00 428/606 |
| 2010/0296687 | A1 * | 11/2010 | Fujita | H04R 7/14 381/398 |

FOREIGN PATENT DOCUMENTS

| | | | | |
|---|---|---|---|---|
| WO | WO 2006042448 | A1 * | 4/2006 | H04R 7/14 |
| WO | WO-2006042448 | A1 * | 4/2006 | H04R 7/14 |

* cited by examiner

SPACE FRAME REINFORCED TWEETER DOME

TECHNICAL FIELD

This patent application is directed to speaker design, and more specifically, to high frequency tweeter domes.

BACKGROUND

A tweeter is a high frequency speaker typically including a voice coil motor connected to a dome shaped diaphragm. As the voice coil vibrates, that movement is transferred to the tweeter's dome which vibrates the air to create an acoustic waveform. Conventional tweeters have either a soft dome or a hard dome construction. Soft domes are typically constructed from a textile material and hard domes typically consist of a thin metal, ceramic, or diamond diaphragm. Soft domes are typically free from ringing (high-frequency breakup mode resonances), but are not sufficiently rigid to follow the accelerations of a music signal at high frequencies. Hard domes are rigid and therefore can generally handle high accelerations at high frequencies, but often suffer from aggressive ringing at the upper end of their frequency spectrum.

BRIEF DESCRIPTION OF THE DRAWINGS

The space frame reinforced tweeter dome described herein may be better understood by referring to the following Detailed Description in conjunction with the accompanying drawings, in which like reference numerals indicate identical or functionally similar elements.

Figure 1:
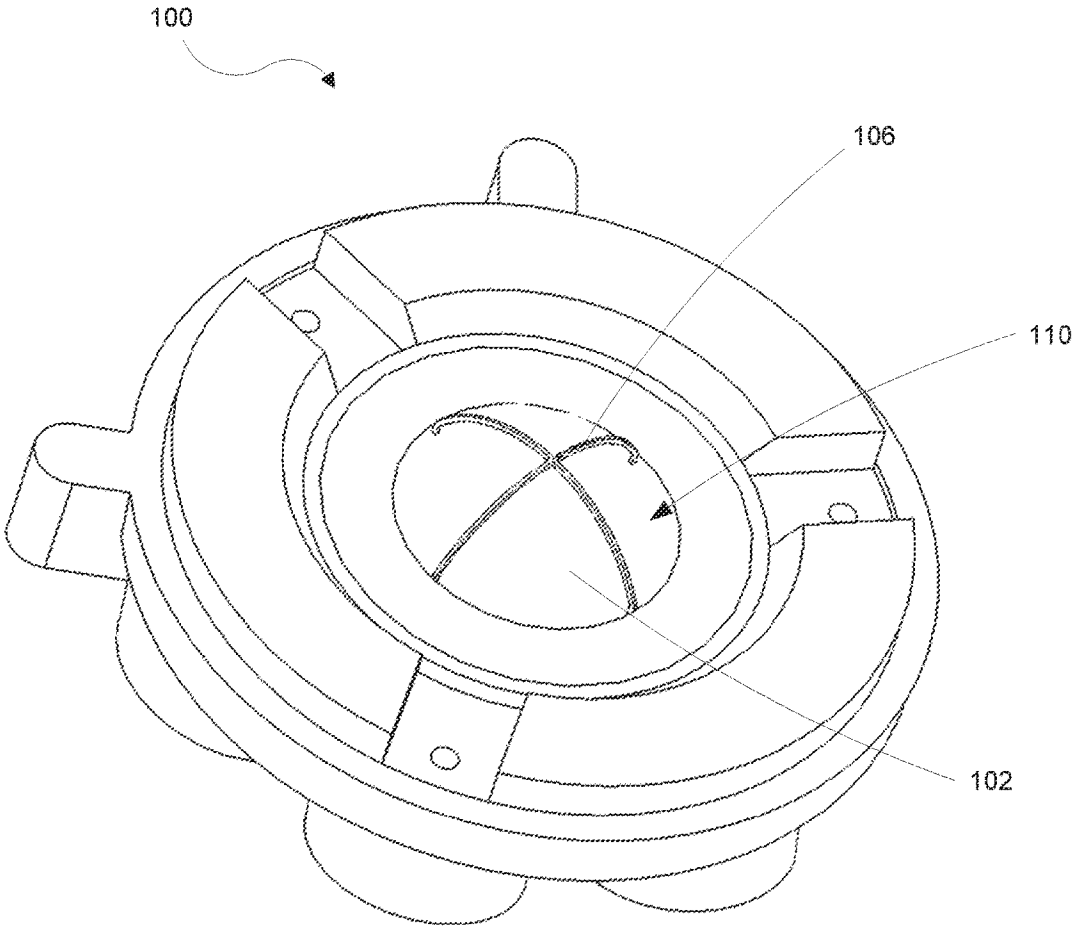
FIG. 1 is an isometric view of a tweeter including a space frame reinforced dome according to a representative embodiment.

The headings provided herein are for convenience only and do not necessarily affect the scope of the embodiments. Further, the drawings have not necessarily been drawn to scale. For example, the dimensions of some of the elements in the figures may be expanded or reduced to help improve the understanding of the embodiments. Moreover, while the disclosed technology is amenable to various modifications and alternative forms, specific embodiments have been shown by way of example in the drawings and are described in detail below. The intention, however, is not to limit the embodiments described. On the contrary, the embodiments are intended to cover all modifications, equivalents, and alternatives falling within the scope of this disclosure.

DETAILED DESCRIPTION

Overview

A space frame reinforced tweeter dome is disclosed. In a representative embodiment, the tweeter dome includes a space frame and a convex diaphragm attached to the space frame. In some embodiments, the space frame includes a crown portion and at least two leg portions extending from the crown portion. In at least one embodiment, the crown portion comprises a triangular frame and the space frame includes three leg portions each extending from a corresponding vertex of the triangular frame. Each leg portion has a distal foot portion adapted for connection to a voice coil former for movement therewith. In some embodiments, the diaphragm is comprised of a soft, e.g., textile, material and the space frame is comprised of a rigid material, such as metal, for example. In some embodiments, the diaphragm is attached to the space frame with adhesive. The disclosed space frame reinforced tweeter domes are free from ringing while being sufficiently rigid to follow the enormous accelerations of a music signal at high frequencies.

General Description

Various examples of the devices introduced above will now be described in further detail. The following description provides specific details for a thorough understanding and enabling description of these examples. One skilled in the relevant art will understand, however, that the techniques and technology discussed herein may be practiced without many of these details. Likewise, one skilled in the relevant art will also understand that the technology can include many other features not described in detail herein. Additionally, some well-known structures or functions may not be shown or described in detail below so as to avoid unnecessarily obscuring the relevant description.

The terminology used below is to be interpreted in its broadest reasonable manner, even though it is being used in conjunction with a detailed description of some specific examples of the embodiments. Indeed, some terms may even be emphasized below; however, any terminology intended to be interpreted in any restricted manner will be overtly and specifically defined as such in this section.

The disclosed space frame reinforced tweeter domes provide the benefits of soft domes and the benefits of hard domes. Soft domes are free from ringing (high-frequency breakup mode resonances), but are not sufficiently rigid to follow the enormous accelerations of a music signal at high frequencies. Hard domes are rigid and therefore can handle high accelerations at high frequencies, but suffer from aggressive ringing at the upper end of their frequency spectrum. The disclosed space frame reinforced tweeter domes are free from ringing while being sufficiently rigid to follow the enormous accelerations of a music signal at high frequencies.

Figure 2:
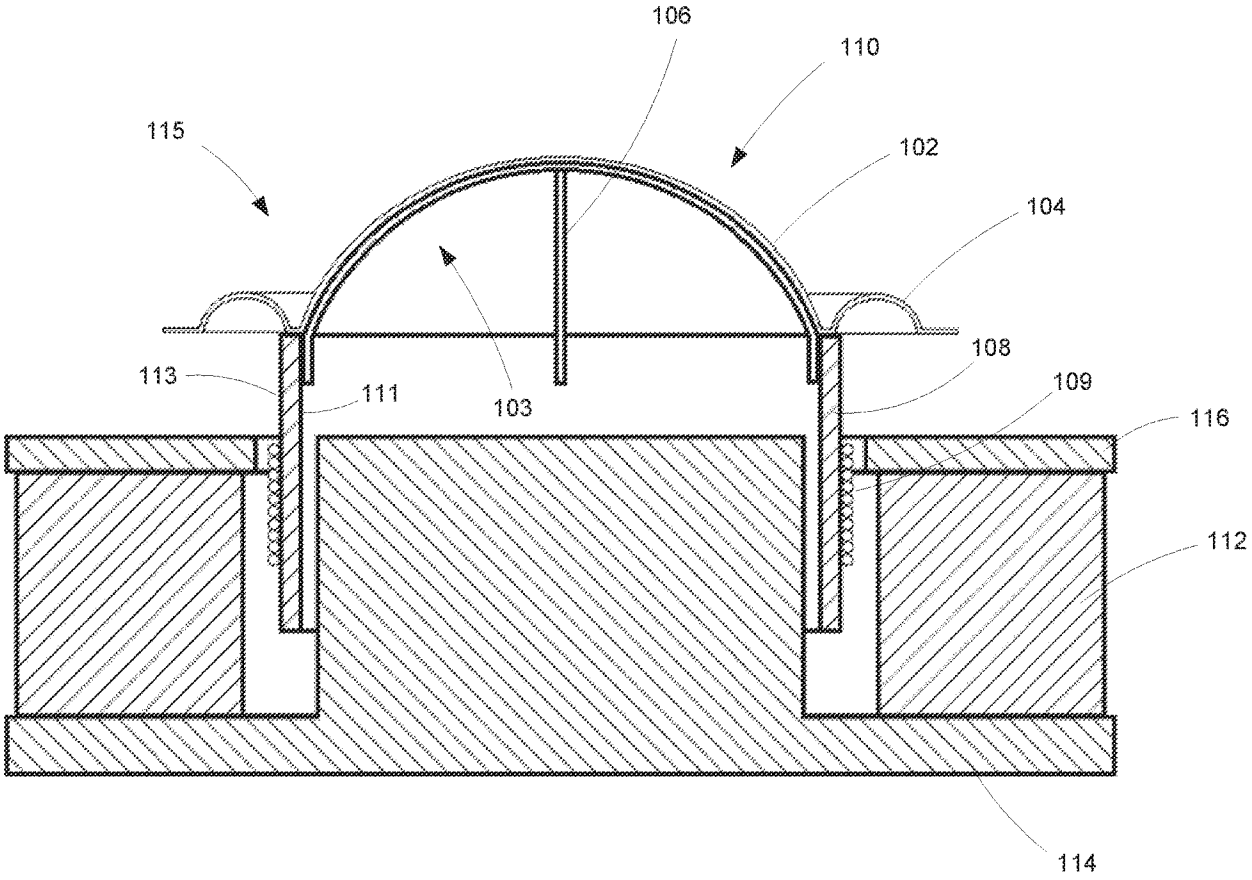
FIG. 2 is a simplified cross-sectional schematic of a tweeter incorporating a space frame reinforced dome according to a representative embodiment.

FIG. 1 illustrates a high-frequency driver, i.e., tweeter 100, that incorporates a space frame reinforced tweeter dome 110 according to a representative embodiment. Tweeter dome 110 includes a convex diaphragm 102 reinforced by a space frame 106 (shown in phantom). With further reference to FIG. 2, the space frame 106 is connected to a voice coil former 108 as part of a tweeter dome assembly 115, which can also include a voice coil 109 and an annular suspension ring 104. The voice coil former 108 is a cylindrical tube having circumferential inner and outer surfaces 111 and 113, respectively. The space frame 106 is connected to the circumferential inner surface 111 and the voice coil 109 is positioned around the circumferential outer surface 113. The suspension ring 104, sometimes referred to as a surround, extends around the diaphragm 102 and suspends the tweeter dome assembly 115 relative to the magnet(s) 112, pole piece 114, and gap plate 116. In some embodiments, the suspension ring 104 is supported by a chassis (not shown). In some embodiments, the diaphragm 102 is comprised of a thin, soft, and/or flexible material, such as textile, polypropylene, silk, or paper, for example. As used herein, convex diaphragm refers to a speaker or tweeter diaphragm having a convex outer surface and a corresponding concave inner surface.

In some embodiments, the space frame 106 is attached to the former 108 with a suitable adhesive. In other embodiments, the space frame 106 is welded, soldered, or similarly joined to the former 108. In some embodiments, the space frame 106 can be attached to the rim of the former 108. In other embodiments, the space frame 106 can be attached to the circumferential outer surface 113.

Figure 3A:
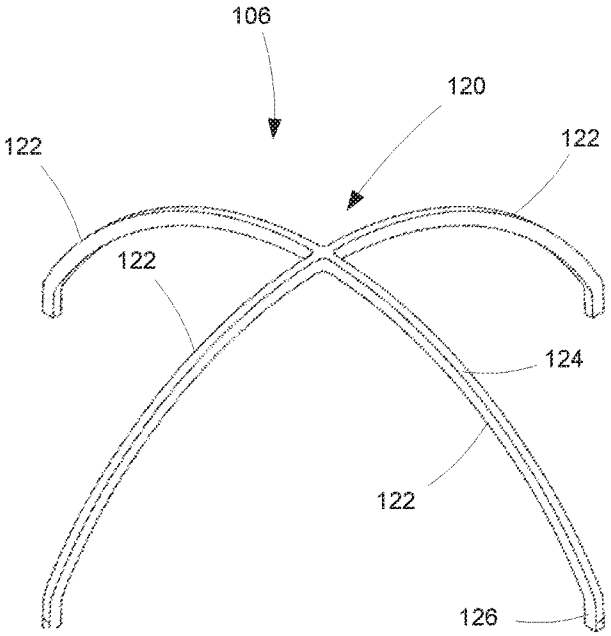
FIG. 3A is an isometric view of the space frame shown in FIGS. 1 and 2.
Figure 3B:
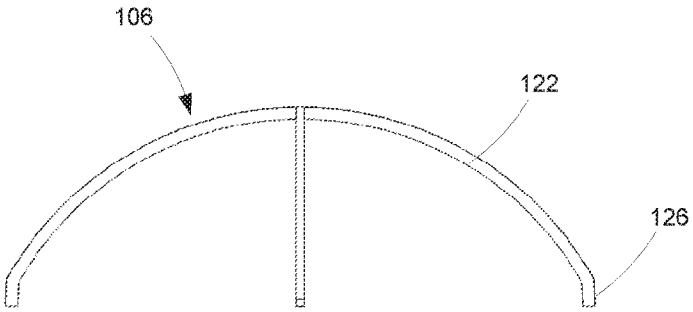
FIG. 3B is a side view in elevation of the space frame shown in FIG. 3A.
Figure 3C:
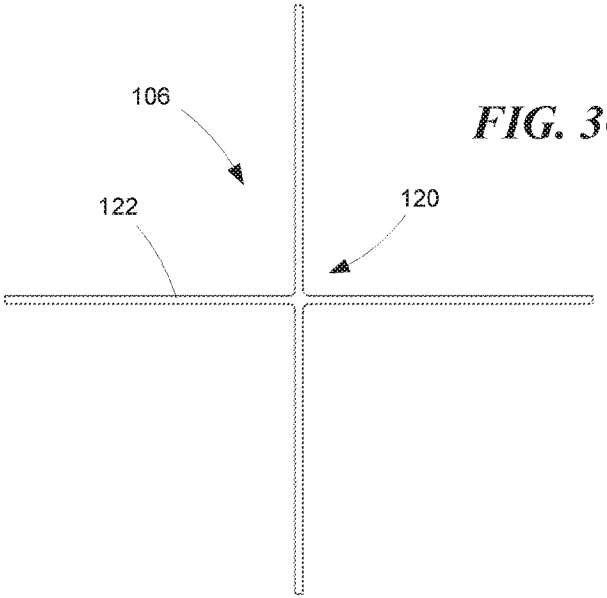
FIG. 3C is a top plan view of the space frame shown in FIGS. 3A and 3B.

As shown in FIG. 2, the convex diaphragm 102 is dome shaped with a concave inner surface defining an interior region 103. The space frame 106 is located in the interior region 103 of the dome and can be adhered to the dome with a suitable adhesive. As shown in FIGS. 3A-3C, the space frame 106 includes a crown portion 120 with four arcuate leg portions 122 extending therefrom. In some embodiments, each leg portion 122 includes an associated distal foot portion 126 adapted for connection to the voice coil former 108 (FIG. 2). The space frame 106 has an outer dome shaped surface 124 substantially matching at least a portion of a contoured surface of the interior region 103. In some embodiments, the space frame 106 comprises strong rigid material, such as metal or plastic. In some embodiments, the space frame 106 comprises machined billet aluminum. In other embodiments, the space frame is formed by stamping, casting, or molding and may depend on the material selected.

Figure 4A:
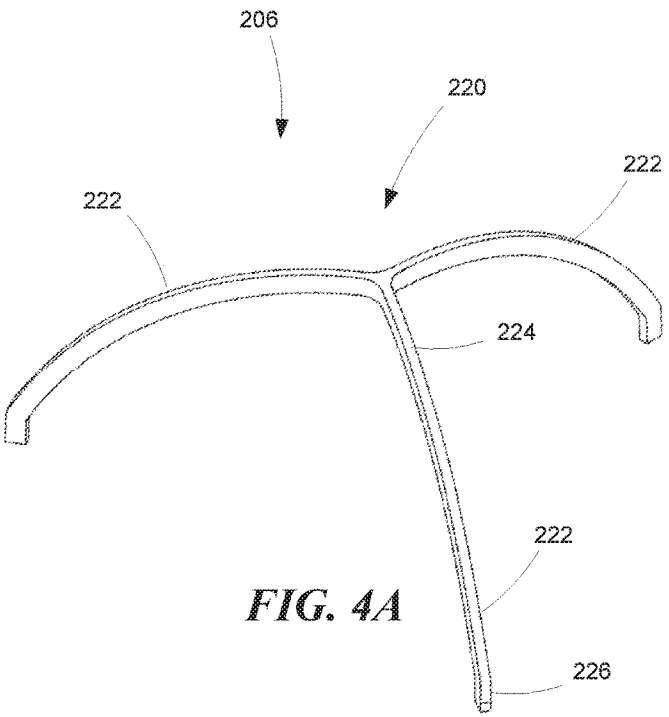
FIG. 4A is an isometric view of the space frame according to another representative embodiment.
Figure 4B:
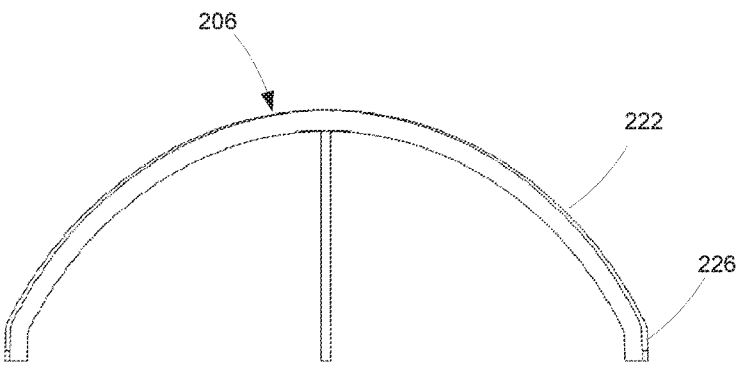
FIG. 4B is a side view in elevation of the space frame shown in FIG. 4A.
Figure 4C:
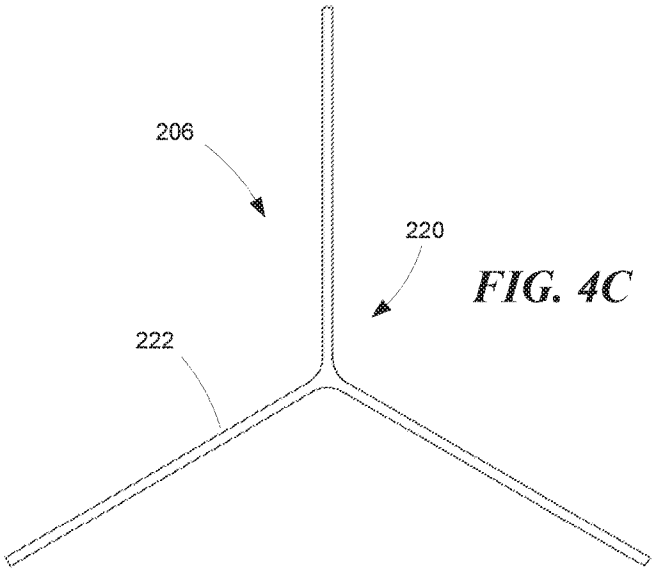
FIG. 4C is a top plan view of the space frame shown in FIGS. 4A and 4B.

FIGS. 4A-4C illustrate a space frame 206 according to another representative embodiment. Space frame 206 is similar to space frame 106 described above with respect to FIGS. 3A-3C except it includes three leg portions 222 instead of four. The space frame 206 includes a crown portion 220 with three arcuate leg portions 222 extending therefrom. Each leg portion 222 includes an associated distal foot portion 226 adapted for connection to the voice coil former 108 (FIG. 2). The space frame 206 has an outer dome shaped surface 224 substantially matching at least a portion of a contoured surface of the interior region 103 (FIG. 2).

Figure 5A:
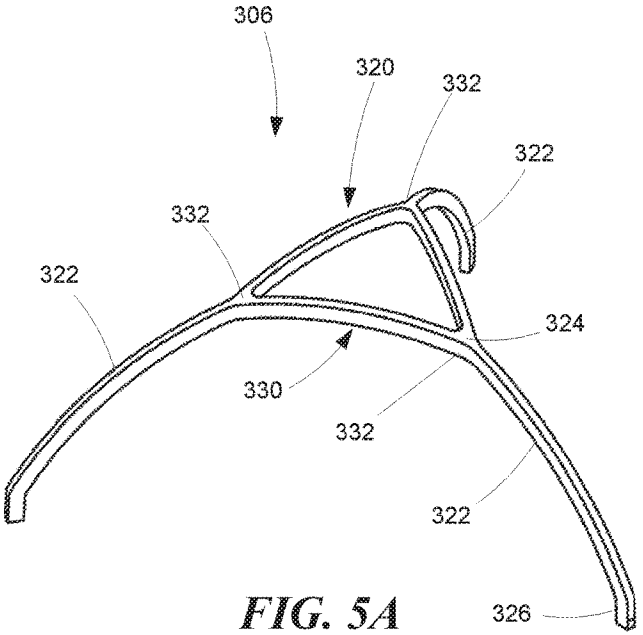
FIG. 5A is an isometric view of the space frame according to another representative embodiment.
Figure 5C:
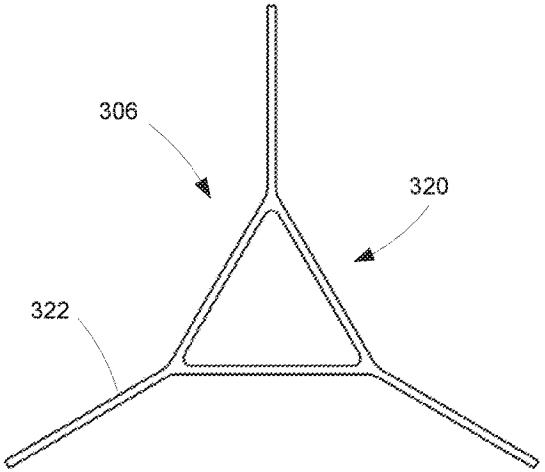
FIG. 5C is a top plan view of the space frame shown in FIGS. 5A and 5B.
Figure 5B:
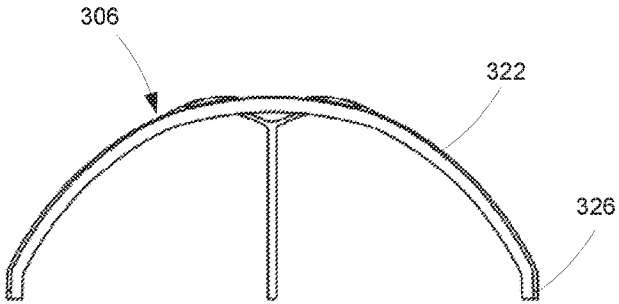
FIG. 5B is a side view in elevation of the space frame shown in FIG. 5A.

FIGS. 5A-5C illustrate a space frame 306 according to another representative embodiment. The space frame 306 includes a crown portion 320 in the form of a triangular shaped hoop or frame 330. Space frame 306 includes three leg portions 322 each extending from a corresponding vertex 332 of the triangular frame 330. Each leg portion 322 includes an associated distal foot portion 326 adapted for connection to the voice coil former 108 (FIG. 2). The space frame 306 has an outer dome shaped surface 324 substantially matching at least a portion of a contoured surface of the interior region 103 (FIG. 2). In other representative embodiments, the crown portion 320 can be any suitable polygonal frame with legs extending from its vertices. For example, in various embodiments, crown portion 320 can be a square or pentagon shaped frame.

Figure 6A:
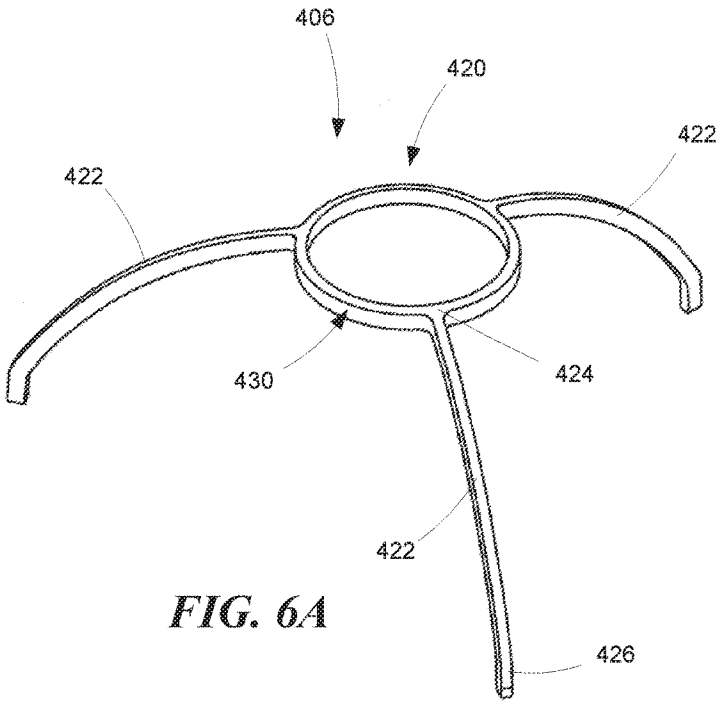
FIG. 6A is an isometric view of the space frame according to another representative embodiment.
Figure 6C:
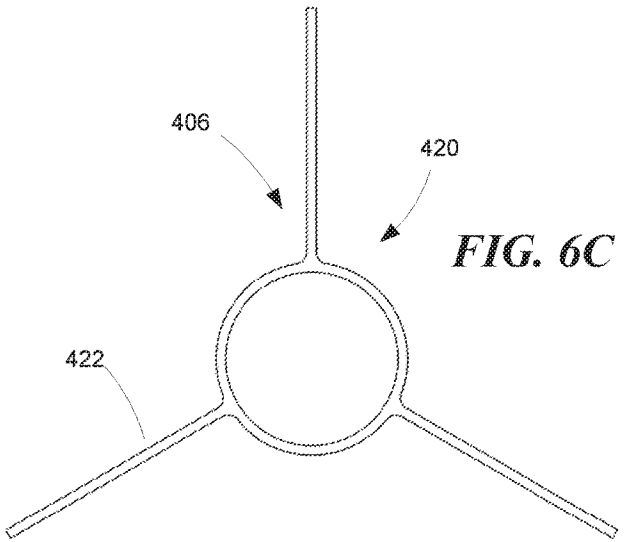
FIG. 6C is a top plan view of the space frame shown in FIGS. 6 and 6B.
Figure 6B:
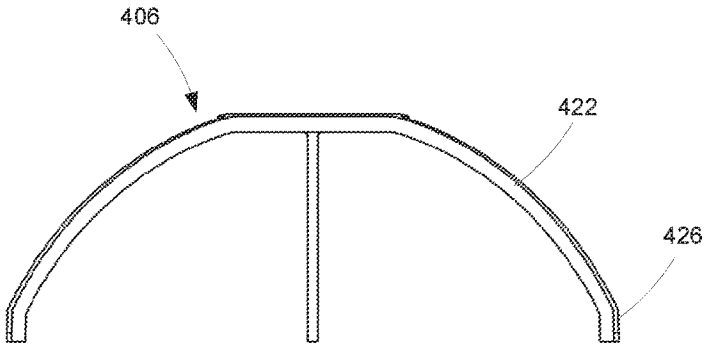
FIG. 6B is a side view in elevation of the space frame shown in FIG. 6A.

FIGS. 6A-6C illustrate a space frame 406 according to another representative embodiment. The space frame 406 includes a crown portion 420 in the form of a circular frame 430. Space frame 406 includes three leg portions 422 each equally spaced around and extending from the circular frame 430. Each leg portion 422 includes an associated distal foot portion 426 adapted for connection to the voice coil former 108 (FIG. 2). The space frame 406 has an outer dome shaped surface 424 substantially matching at least a portion of a contoured surface of the interior region 103 (FIG. 2).

FIGS. 7-10 present frequency response measurements for four tweeters: a soft dome tweeter, two hard dome (aluminum and beryllium) tweeters, and a tweeter incorporating the disclosed space frame reinforced tweeter dome. Each graph shows how loud (dB) the tweeter plays for a given input voltage (the industry standard used is 2.83 Volts) across the frequency (Hz) range. Tweeters are only expected to play from about 1.5 kHz upward, below which other speaker-drivers take over. Therefore, performance below 1.5 kHz can be ignored. An ideal tweeter would produce a smooth, horizontal line from 1.5 kHz to at least 40 kHz. Although it is traditionally believed that the human ear has an upper frequency limit of about 20 kHz, audiophiles typically look at measurements up to 40 kHz or even beyond.

Figure 7:
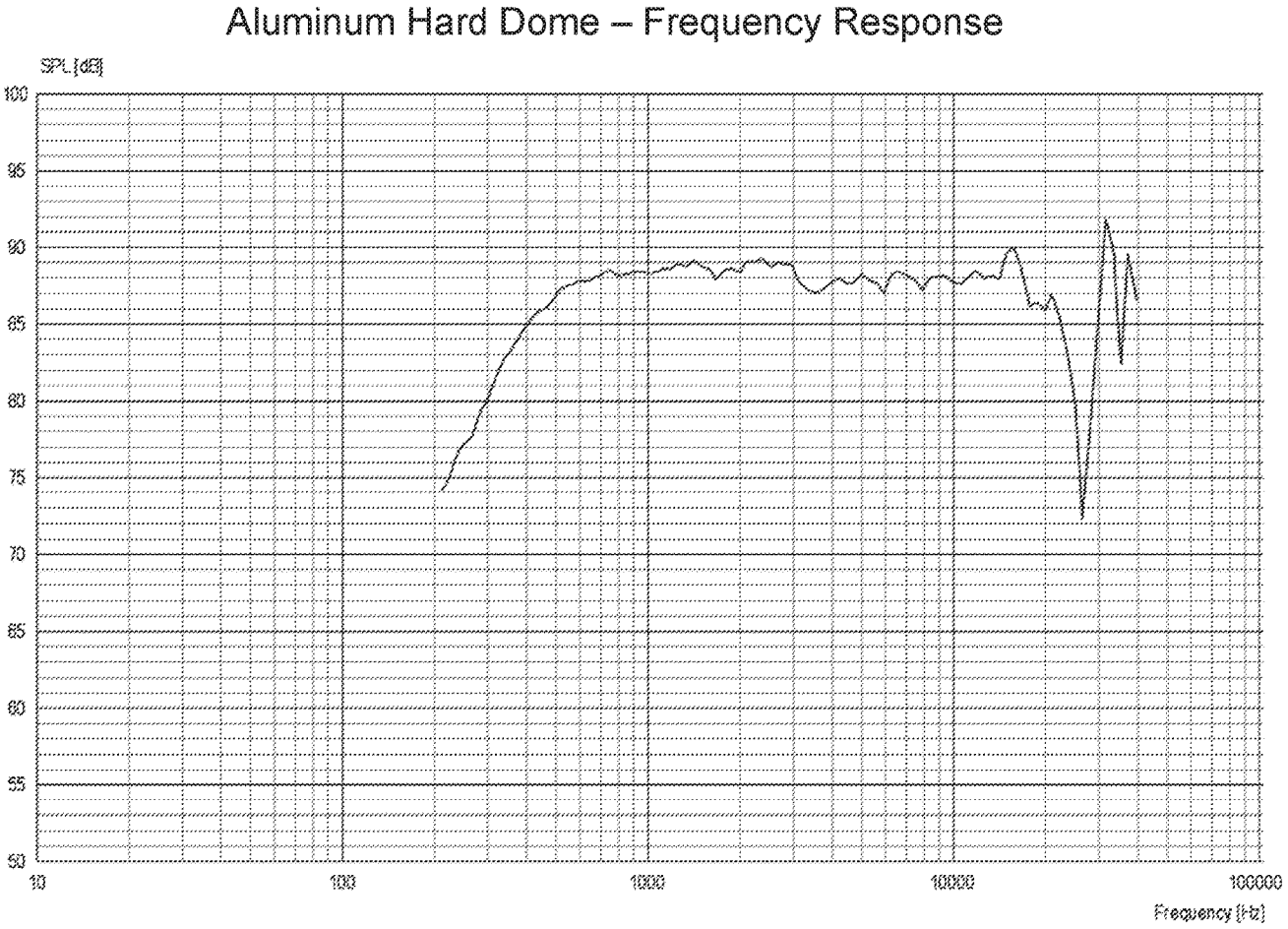
FIG. 7 is a frequency response graph for a conventional aluminum hard dome.
Figure 8:
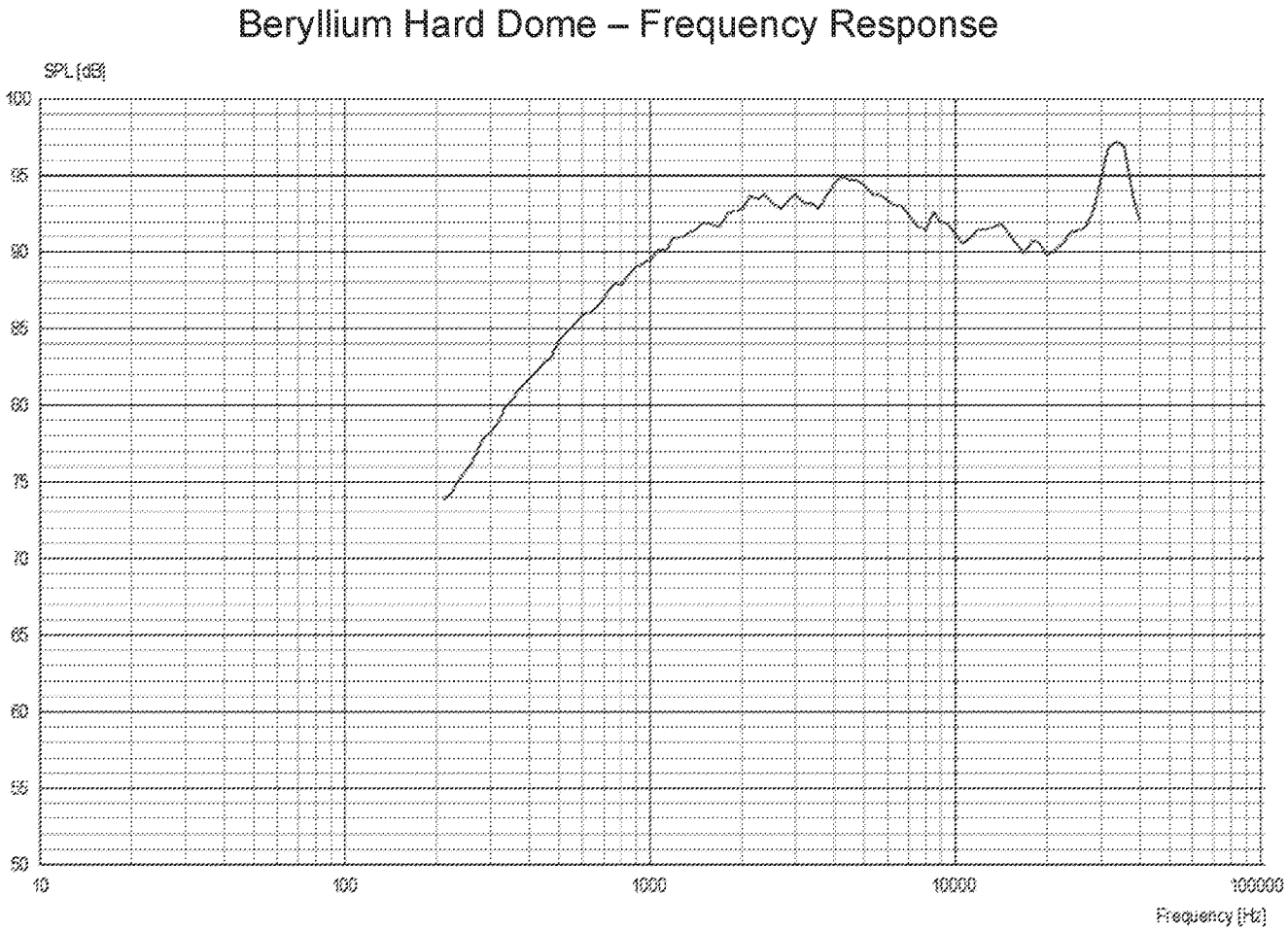
FIG. 8 is a frequency response graph for a conventional beryllium hard dome.

As can be appreciated in FIGS. 7 and 8, the aluminum hard dome and the beryllium hard dome produce a smooth line up to about 18 kHz for aluminum and 25 kHz for beryllium. Beyond that point they both exhibit strong ringing that peaks at around 31 kHz and 34 kHz, respectively. Ringing is an undesirable characteristic of hard dome tweeters, which is associated by many listeners with a harsh, "metallic" sound.

Figure 9:
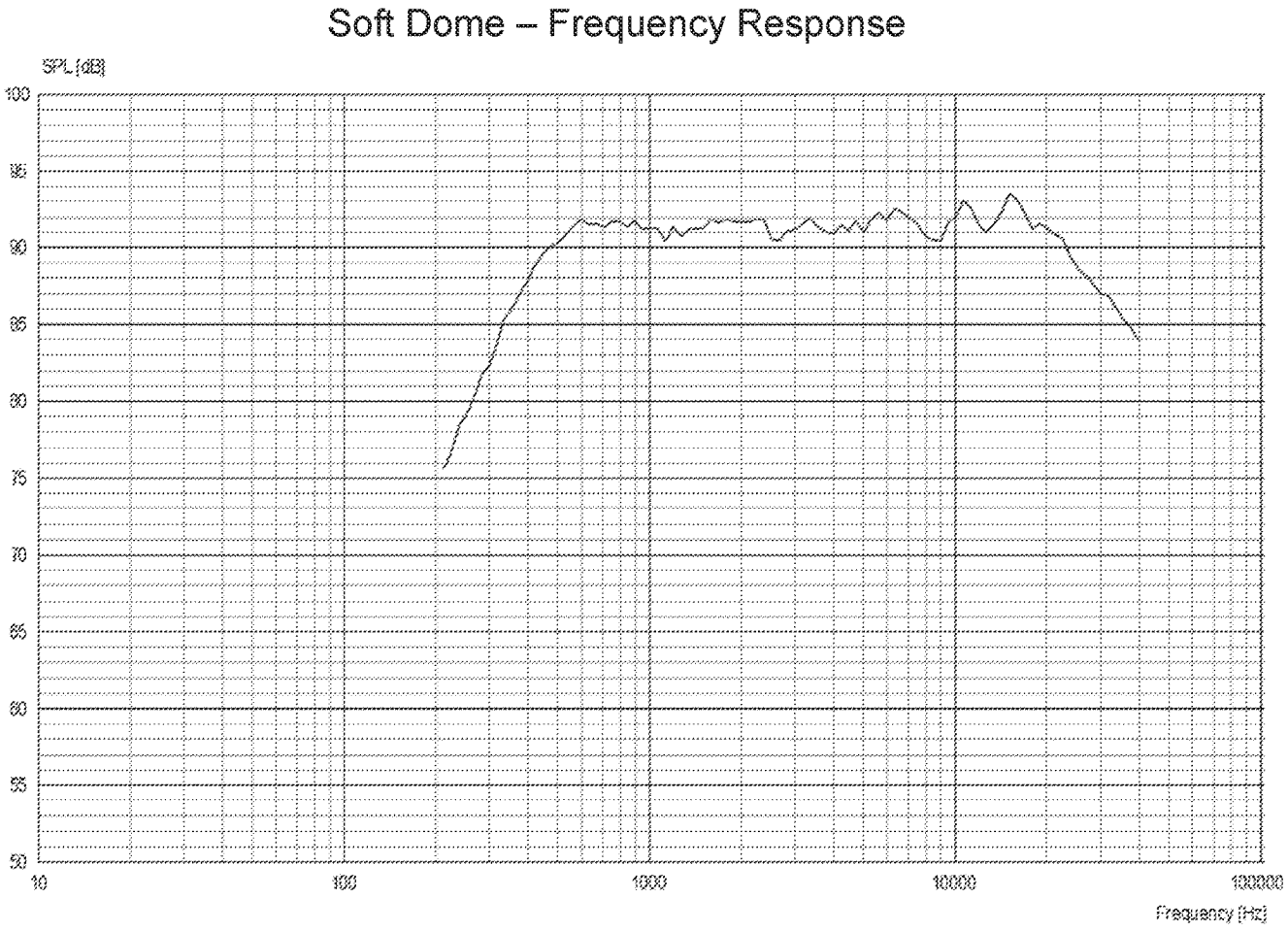
FIG. 9 is a frequency response graph for a conventional soft dome.

As can be appreciated in FIG. 9, the soft dome produces a fairly horizontal line up to approximately 20 kHz, at which point output rapidly decreases. The soft dome has lost an unacceptable 7 dB of output at 40 kHz; however, it has no ringing (resonance peaks) at the higher frequencies.

Figure 10:
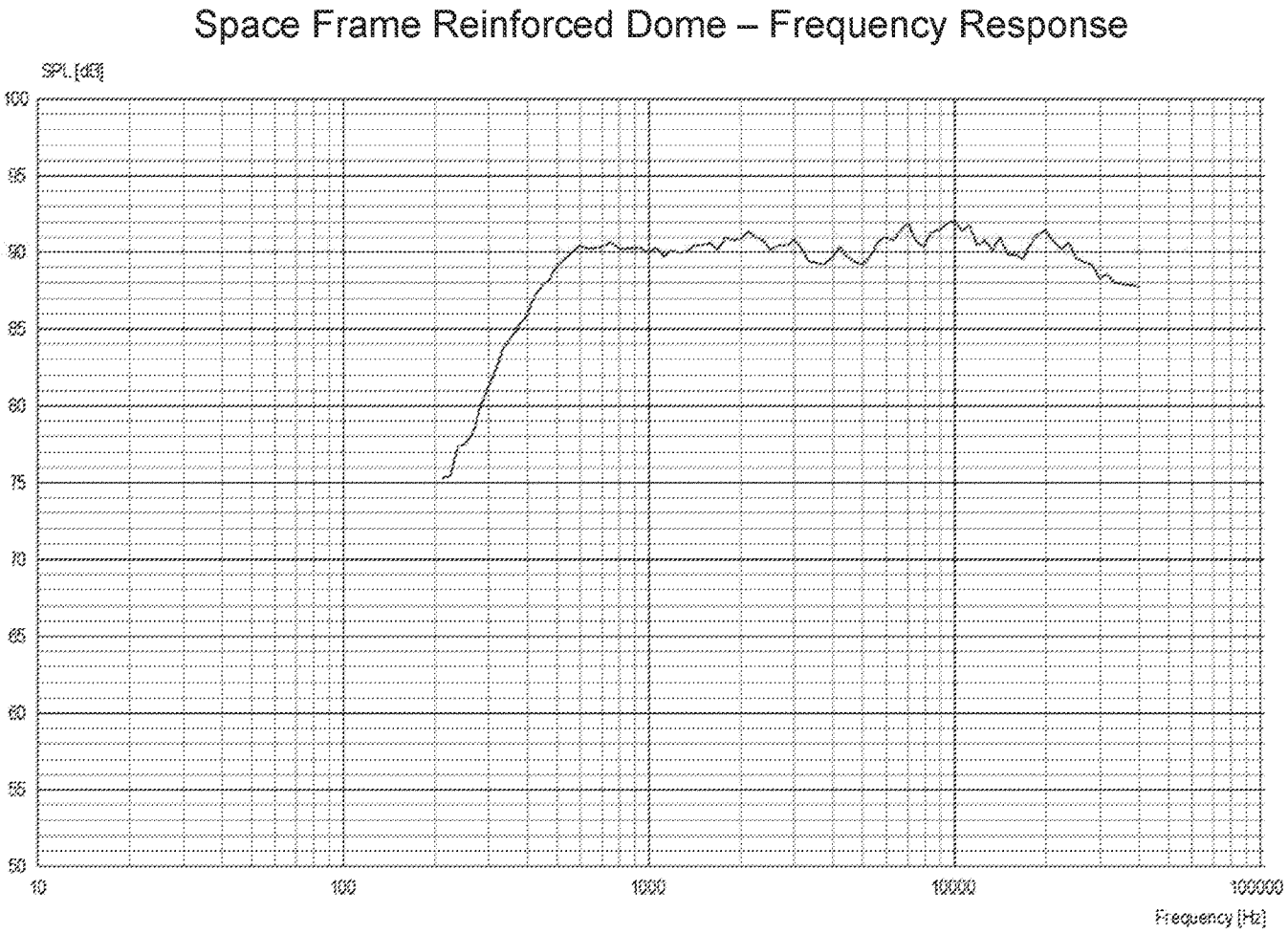
FIG. 10 is a frequency response graph for a space frame reinforced tweeter dome according to the disclosed technology.

With reference to FIG. 10, it can be appreciated that the disclosed space frame reinforced tweeter dome has the best performance of the four speakers. The space frame reinforced tweeter dome has only lost about 2 dB of output at 40 kHz, and achieves this wide bandwidth without resonance peaks.

Remarks

The above description, drawings, and appendices are illustrative and are not to be construed as limiting. Numerous specific details are described to provide a thorough understanding of the disclosure. However, in some instances, well-known details are not described in order to avoid obscuring the description. Further, various modifications may be made without deviating from the scope of the embodiments.

For example, although the tweeter diaphragm disclosed herein is described in terms of a space frame reinforced dome, the space frame technology applies to frames and diaphragms having other concave or convex shapes, including for example geodesic domes. In addition, the disclosed technology can apply to inverted domes and flat diaphragms, for example. Furthermore, although the technology is described with respect to tweeters, the space frame can be applied to other types of speakers and speakers having the same or different frequency responses, for example.

Moreover, in some embodiments, the space frame can be located on the outside, or convex side of the diaphragm or dome and correspondingly attached (e.g., adhered) thereto. In such embodiments, the legs and/or foot portions of the space frame can extend through the diaphragm or dome.

As used herein, tweeter dome refers generically to the speaker's diaphragm whether it is an arcuately domed or an otherwise concave/convex diaphragm. Space frame refers to space frames, frames, and/or other structures for supporting the tweeter diaphragm or dome according to the above disclosed technology.

Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

The terms used in this specification generally have their ordinary meanings in the art, within the context of the disclosure, and in the specific context where each term is used. It will be appreciated that the same thing can be said in more than one way. Consequently, alternative language and synonyms may be used for any one or more of the terms discussed herein, and any special significance is not to be placed upon whether or not a term is elaborated or discussed herein. Synonyms for some terms are provided. A recital of one or more synonyms does not exclude the use of other synonyms. The use of examples anywhere in this specification, including examples of any term discussed herein, is illustrative only and is not intended to further limit the scope and meaning of the disclosure or of any exemplified term. Likewise, the disclosure is not limited to various embodiments given in this specification. Unless otherwise defined, all technical and scientific terms used herein have the same meaning as commonly understood by one of ordinary skill in the art to which this disclosure pertains. In the case of conflict, the present document, including definitions, will control.

What is claimed is:

1. A tweeter dome, comprising:
- a space frame, including:
  - a crown portion comprising a hoop, and
  - at least two leg portions extending from the hoop, wherein each leg portion has a distal foot portion adapted for direct connection to a circumferential inner surface of a voice coil former for movement therewith;
  - wherein the at least two leg portions support the hoop away from the voice coil former; and
- a convex diaphragm attached to the space frame.

2. The tweeter dome of claim 1, wherein the leg portions comprise arcuate members configured to substantially match a contoured surface of the convex diaphragm.

3. The tweeter dome of claim 1, wherein the convex diaphragm is dome shaped.

4. The tweeter dome of claim 1, wherein the convex diaphragm defines an interior region and wherein the space frame is located in the interior region.

5. The tweeter dome of claim 1, wherein the convex diaphragm is attached to the space frame with adhesive.

6. The tweeter dome of claim 1, wherein the crown portion comprises a polygonal frame and the space frame includes a plurality of leg portions each extending from a corresponding vertex of the polygonal frame.

7. A tweeter dome assembly, comprising:
- a cylindrical voice coil former having a circumferential inner surface and a circumferential outer surface;
- a tweeter dome, including:
  - a space frame including a hoop and at least two legs extending therefrom, each leg having a distal foot portion directly connected to the circumferential inner surface of the voice coil former thereby supporting the hoop away from the voice coil former; and
  - a dome shaped diaphragm attached to the space frame.

8. The tweeter dome assembly of claim 7, wherein the dome shaped diaphragm defines an interior region and wherein the space frame is located in the interior region.

9. The tweeter dome assembly of claim 8, wherein the space frame has an outer dome shaped surface substantially matching at least a portion of a contoured surface of the interior region.

10. The tweeter dome assembly of claim 7, wherein the dome shaped diaphragm is attached to the space frame with adhesive.

11. The tweeter dome assembly of claim 7, wherein the space frame is attached to the circumferential inner surface with adhesive.

12. The tweeter dome assembly of claim 7, further comprising a suspension ring extending around the dome shaped diaphragm.

13. The tweeter dome assembly of claim 7, further comprising a voice coil positioned around the circumferential outer surface.

14. A tweeter, comprising:
- a magnet;
- a pole piece connected to the magnet; and
- a tweeter dome assembly, including:
  - a cylindrical voice coil former;
  - a voice coil positioned around the voice coil former;
  - a tweeter dome, including:
    - a space frame including a hoop spaced away from the voice coil former and a plurality of leg portions extending therefrom, each leg portion having a distal foot portion attached to a circumferential inner surface of the voice coil former; and
    - a convex diaphragm attached to the space frame; and
  - a suspension ring extending around the convex diaphragm operative to suspend the tweeter dome assembly relative to the magnet and pole piece.

15. The tweeter of claim 14, wherein the space frame has an outer dome shaped surface substantially matching at least a portion of an inner concave surface of the convex diaphragm.

16. The tweeter of claim 14, wherein the convex diaphragm is attached to the space frame with adhesive.

17. The tweeter dome assembly of claim 7, wherein the hoop is in the form of a circular frame.

18. The tweeter dome assembly of claim 7, wherein the hoop comprises a polygonal frame and each of the plurality of leg portions extends from a corresponding vertex of the polygonal frame.

19. The tweeter of claim 14, wherein the hoop comprises a polygonal frame and each of the plurality of leg portions extends from a corresponding vertex of the polygonal frame.

20. The tweeter of claim 19, wherein the polygonal frame is triangular in shape.

* * * * *